United States Patent [19]

Cudzik

[11] 3,967,753

[45] July 6, 1976

[54] EASY-OPEN WALL

[75] Inventor: Daniel F. Cudzik, Richmond, Va.

[73] Assignee: Reynolds Metals Company, Richmond, Va.

[22] Filed: July 26, 1974

[21] Appl. No.: 492,033

Related U.S. Application Data

[63] Continuation-in-part of Ser. Nos. 293,115, Sept. 28, 1972, Pat. No. 3,836,038, and Ser. No. 378,448, July 12, 1973, abandoned.

[52] U.S. Cl. ..... 220/269; 220/334

[51] Int. Cl.[2] ..... B65D 41/32

[58] Field of Search ..... 220/268, 269, 270, 334, 220/339, 267, 277

[56] References Cited

UNITED STATES PATENTS

| | | | |
|---|---|---|---|
| 2,085,200 | 6/1937 | Ljungstrom | 220/270 |
| 2,828,883 | 4/1958 | Holler | 220/269 |
| 3,215,305 | 11/1965 | Frankenberg | 220/269 |
| 3,289,880 | 12/1966 | Wilkich | 220/268 |
| 3,322,296 | 5/1967 | Khoury | 220/273 |
| 3,338,460 | 8/1967 | Cookson | 220/269 |
| 3,401,823 | 9/1968 | Fraze | 220/269 |
| 3,435,977 | 4/1969 | Jacke | 220/268 |
| 3,730,379 | 5/1973 | Brown | 220/273 |
| 3,744,666 | 7/1973 | Heffner | 220/269 |
| 3,744,667 | 7/1973 | Fraze et al. | 220/269 |
| 3,813,000 | 5/1974 | Underwood | 220/269 |
| 3,843,011 | 10/1974 | Perry | 220/269 |
| R27,518 | 10/1972 | Brown | 220/269 |

*Primary Examiner*—George T. Hall

*Attorney, Agent, or Firm*—Glenn, Palmer, Lyne, Gibbs & Clark

[57] ABSTRACT

An easy-open wall is provided for a container and comprises curvilinear score means in such wall defining at least the major part of the peripheral outline of a panel which is partially severable from the wall to define a dispensing opening in the wall. A tab is attached in a nondetachable manner against the wall outwardly of the panel with the tab having a forward portion which overlies part of the panel and having a rear portion. The rear portion is easily grasped and lifted to urge the forward portion against the panel to thereby sever the major portion of said panel along the score means and move it within the container with a portion of the wall holding the panel securely thereto. The tab may be provided with means for fastening it flatly against the wall after using the tab to sever the panel.

16 Claims, 47 Drawing Figures

EASY-OPEN WALL

CROSS-REFERENCE TO RELATED APPLICATION

This is a continuation-in-part of applicant's copending applications Ser. No. 293,115 filed Sept. 28, 1972, now U.S. Pat. No. 3,836,038 granted Sept. 17, 1974, and Ser. No. 378,448 filed July 12, 1973 and now abandoned.

BACKGROUND OF THE INVENTION

There are numerous containers such as beverage cans, for example, in current use wherein each has a comparatively small tear strip provided in an end wall thereof and each has a pull device attached to the tear strip to enable severing of the tear strip and removal thereof from the end wall to provide an opening in such end wall. These completely severed tear strips have sharp edges and are difficult to handle safety. In addition, the severed tear strips with their attached tabs are often carelessly discarded and pose not only a serious litter problem but particularly in recreational areas such as playgrounds, beaches, and the like, where people are likely to walk barefoot the sharp edges on these tear strips often cause serious cuts.

SUMMARY

This invention provides an improved easy-open wall which is particularly adapted to be used as an end wall for a beverage container, or the like, and has a tab and tear strip which remain attached to the container after the tear strip is severed to define a dispensing opening in the easy-open wall.

The wall comprises score means in such wall defining at least the major part of the peripheral outline of a panel which is partially severable from the wall to define the dispensing opening in the wall. A tab is attached in a nondetachable manner against the wall outwardly of the panel with tab having a forward portion which overlies part of the panel and having a rear portion. The rear portion is easily grasped and lifted to urge the forward portion against the panel to thereby sever the major portion of said panel along the score means and move it within the container with a portion of the wall holding the panel securely thereto. The tab may be provided with means for fastening it flatly against the wall after using the tab to sever the panel and such tab may be of the type capable of providing a high mechanical advantage to facilitate the severing of the panel.

Other details, uses and advantages of this invention will become apparent as the following description of the exemplary embodiments thereof presented in the accompanying drawings proceeds.

BRIEF DESCRIPTION OF THE DRAWINGS

The accompanying drawings show present preferred embodiments of this invention, in which.

DESCRIPTION OF ILLUSTRATED EMBODIMENTS

Figure 1:
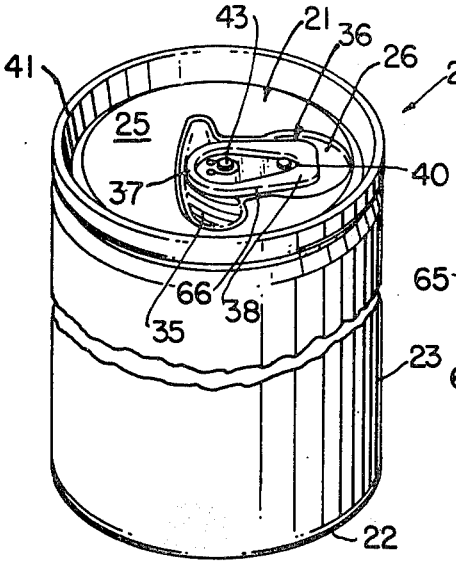
FIG. 1 is a perspective view of an exemplary container with the central portion thereof broken away and illustrating an easy-open wall of this invention provided as a top wall of such container.

Reference is now made to FIG. 1 of the drawings, which illustrates one exemplary embodiment of a container which is designated generally by the reference numeral 20 and which utilizes an easy-open wall in the form of a top wall 21 which is made in accordance with the teachings of this invention. The remainder of container 20 may be of any suitable conventional construction and includes a bottom wall 22 adjoined by a substantially right circular cylindrical side wall 23, and the bottom wall 22 and side wall 23 may be provided as a single piece construction or may be made of a plurality of pieces in accordance with known manufacturing techniques.

Figure 3:
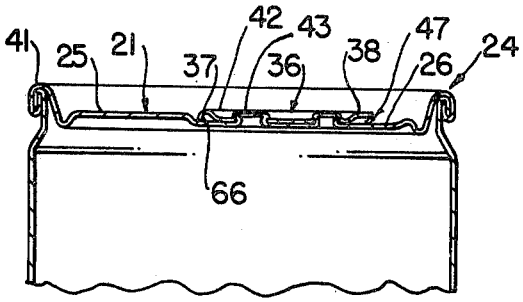
FIG. 3 is a fragmentary, cross-sectional view taken essentially on the line 3—3 of FIG. 2.

The top wall 21 may be fastened to the top portion of the side wall 23 using any suitable technique and in this example the top portion of the side wall 23 is necked inwardly to produce a smaller diameter tubular portion at the top of wall 23 and thereby enable top wall 21 to be fastened in position by a simple mechanical swaging technique to produce a top annular bead on the container as illustrated at 24 in FIG. 3, with such bead being within the circumferential outline of the cylindrical side wall 23.

The wall 21 has a planar portion 25 and a recess 26 provided in such planar portion and the purpose of such recess will be described in detail subsequently. The wall 21 also has continuous curvilinear score means in the form of an approximately U-shaped score line provided therein which is designated generally by the reference numeral 30 and the score line has a bight 31 and a pair of extension legs or extensions 32 extending from such bight and terminating in spaced ends 33 having a portion 34 of the wall 21 remaining therebetween. The score line 30 defines a panel 35 which is completely severable from the wall along the bight 31 and along the extensions 32 adjoining such bight while remaining attached to the wall portion 34 to define an opening 0 in the wall 21 and thus enable the contents of the container 20 to be poured therethrough regardless of whether such contents are in solid pellet form such as popcorn or liquid form such as a carbonated beverage; however, for simplicity the description which follows will be directed to a top wall particularly adapted for use on a beverage can.

The wall 21 has a tab 36 which is attached thereto in a non-detachable manner and as will be described in more detail subsequently and the tab has a forward portion 37 which overlies a part of the panel 35 and a rear portion 38 which is arranged remote from such panel. The rear portion 38 of the tab 36 is easily grasped and lifted to urge the forward portion downwardly in a pivoted manner against the panel 35 to thereby sever the panel and move it within the container with the wall portion 34 holding the panel 35 securely to the wall.

The opening 0 defined by severing the panel 35 has all of the essential easy pouring characteristics of a similar opening defined in a top wall of a conventional can be completely severing and discharging a similar tear-out panel, yet the panel 35 and tab 36 remain attached to the wall 21. Further, if desired the tab 36 may be returned to its original position substantially flatly against the wall 21 due to its construction and arrangement and in the event it is desired to hold such tab substantially in its original position fastening means is provided for fastening such tab in position and in a manner to be described subsequently and such fastening means is designated generally by the reference numeral 40.

The major portion of the top wall 21 including planar portion 25, tab 36, etc., is recessed beneath the top annular edge 41 of container 20 so that the tab 36 is in a protected position. In addition, the tab 36 is nested within the recess 26 so that its top surface 42 is parallel to and approximately coplanar with the planar portion 25, see FIG. 3.

The tab 36 is attached to the wall 21 by a rivet 43 at a location between the forward portion 37 and rear portion 38 of such tab and the rivet serves as a pivot allowing pivoting movement of the tab thereabout. The rivet 43 is defined as an integral part of such wall at a location closely spaced from and near the center of one of the pair of extensions 32 (see FIGS. 2, 3, and 3A) and is located so that substantially the entire forward portion 37 of the tab overlies the center portion of the panel 35. The rivet 43 is in the form of a substantially cylindrical hollow member with an inverted cup-like shape and a wall thickness which is substantially equal to the thickness of the remainder of wall 21. Nevertheless, it will be appreciated that tab 36 may be attached in position by other suitable means such as additional attaching means.

Figure 3A:
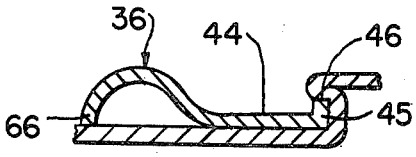
FIG. 3A is an enlarged fragmentary cross-sectional view illustrating the detailed constuction of the pull tab comprising the top wall of FIG. 2 in the area adjoining a rivet used to attach such tab to the top wall.

The tab 36 is subjected to substantial tearing forces in the area 44 thereof adjacent the rivet 43, see FIG. 3A. To counteract any tendency for the tab to tear at this location an integral reinforcing flange 45 of tubular configuration is defined in the tab and such flange has a top annular surface 46 against which the head portion of rivet 43 is riveted to firmly attach the tab 36 in position. The tubular reinforcing flange 45 also defines an improved pivot connection for the tab 36.

Having described the major portions of the easy-open top wall 21, the description will now proceed with a brief presentation of the manner in which the wall 21 may be easily opened and the contents thereof, such as a beverage or the like, poured therefrom in the usual manner yet with the severable panel 35 and pull tab 36 remaining attached to the wall 21. In particular, it will be seen that it is a simple matter to insert an object such as a fingernail or the like beneath the terminal edge of the rear portion 38 of tab 36 as illustrated at 47 in FIGS. 2 and 3 whereupon such tab may be pivoted about the rivet 43 to sever the panel 35.

Figure 5:
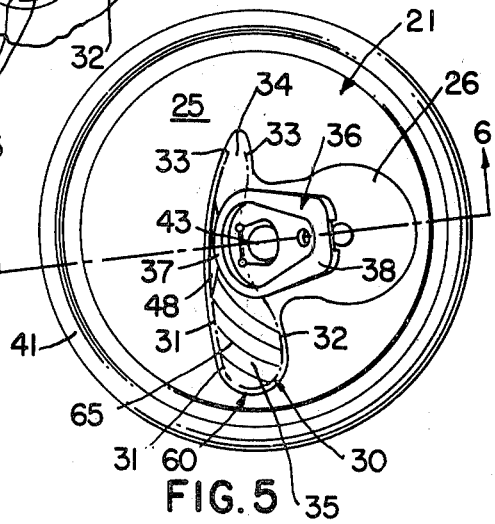
FIG. 5 is a top plan view illustrating the pull tab comprising the top wall of the container of FIG. 1 partially lifted to commence severing the severable panel provided in such top wall.
Figure 6:
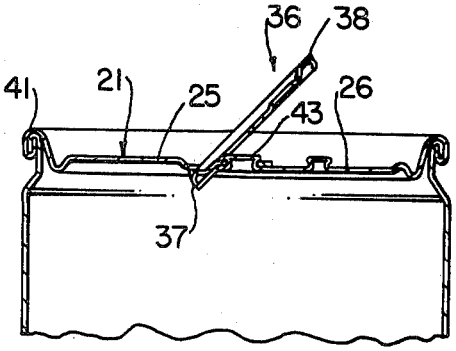
FIG. 6 is a fragmentary cross-sectional view taken essentially on the line 6—6 of FIG. 5.

Initial pivoting movement of the tab 36 from planar portion 25 through an angular increment illustrated in FIG. 6 provides an initial severing of the panel 35 to define a narrow elongated opening 48 in the top wall 21 as shown in FIG. 5. Further pivoting movement of the tab 36 to a substantially vertical position as illustrated at 49 in FIG. 8, results in practically the entire panel 35 being severed to define the opening 0. In general, only the wall portion 34 holds the panel 35 securely attached to the top wall 21 and portion 34 is more than adequate for this purpose, however, occassionally the panel 35 may also remain attached to wall 21 along a terminal portion of the extension 32 closely adjacent the rivet 43 as illustrated at 50. The opening 0 thus defined is such that a beverage may be poured from the lower enlarged end thereof in an unobstructed manner because the panel 35 is attached to the opposite end of the opening 0.

Figure 9:
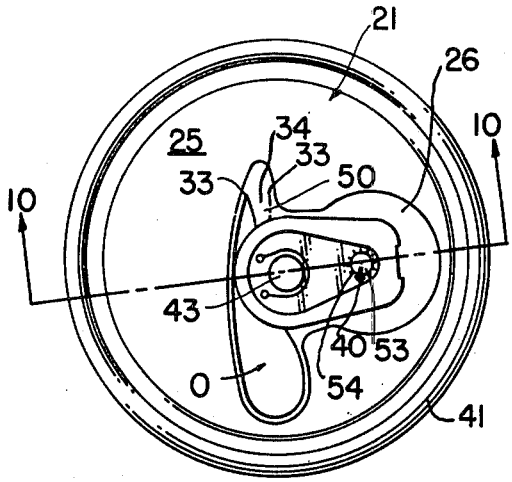
FIG. 9 is a view similar to FIG. 2 and illustrating the tab returned to its original position substantially flatly against the top wall and fastened in position by fastening means comprising such top wall.
Figure 8:
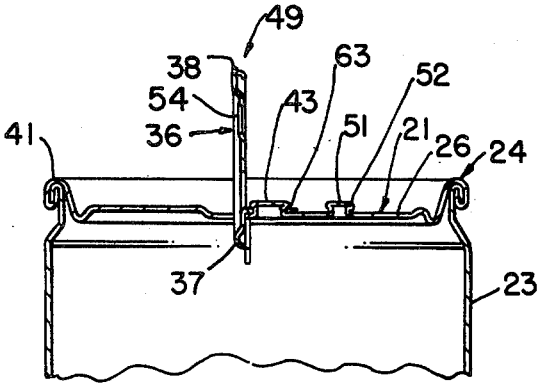
FIG. 8 is a fragmentary cross-sectional view taken essentially on the line 8—8 of FIG. 7.

The tab 36 may be left in the substantially vertical position illustrated in FIG. 8; however, for applications where container 20 contains a beverage and it is desired to drink directly through opening 0 the tab 36 may be readily returned to its original position flatly against the wall 21 and, if desired, held in position by the fastening means 40 as shown in FIG. 9.

Figure 7:
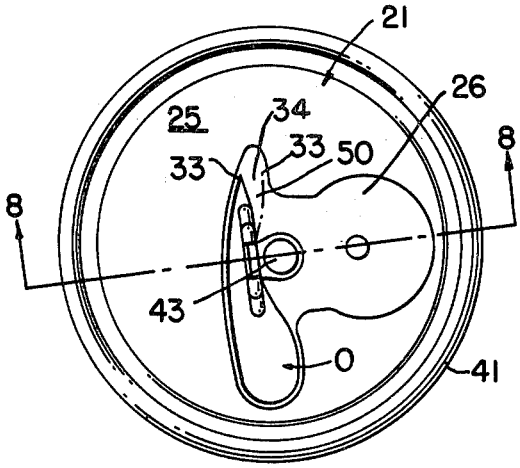
FIG. 7 is a view similar to FIG. 5 illustrating the tab of FIG. 5 raised to a substantially vertical position.
Figure 10:
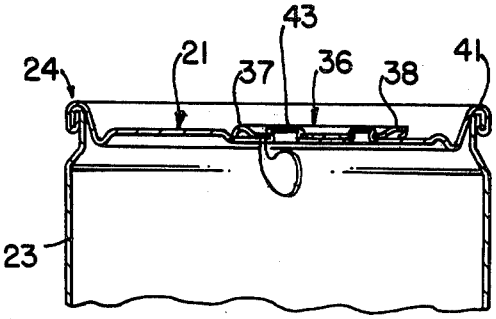
FIG. 10 is a fragmentary; cross-sectional view taken essentially on the line 10—10 of FIG. 9 and showing the panel pushed within the container while being held thereto at one end portion thereof.

The tab 36 is shown in a substantially vertical position in FIG. 8 of the drawings; however, it will be appreciated that such tab may be moved through an angle substantially greater than 90°, if desired, to assure that the opening 0 is essentially as shown in FIGS. 7, 9 and 10 and unobstructed by the panel 35 to enable smooth free pouring or drinking therethrough.

Figure 9A:
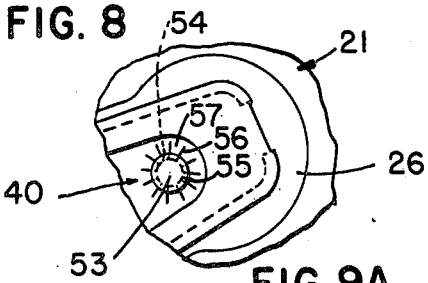
FIG. 9A is a fragmentary view of the central portion of the top wall particularly illustrating the tab fastening means.

The fastening means 40 will be described making particular reference to FIGS. 8, 9 and 9A of the drawings and such fastening means comprises a member 51 which is defined as an integral part of the wall 21 and member 51 is in the form of a cylindrical hollow rivet member having a wall thickness which is substantially the same thickness as the top wall 21. The member 51 of this example has a head portion 52 which has particular maximum planar area 53 within its peripheral outline. The fastening means 40 also comprises a cooperating open area in the form of an aperture 54 provided in the tab 36 and the cooperating circular aperture 54 has an area which is slightly smaller than the above-mentioned area 53 thereby enabling the tab 36 to be urged against the upper portion so that peripheral surface portions 55 thereof defining aperture 54 are wedged against the upper portion of the member 51 to fasten the tab flatly against the top wall 21.

The tab 36 also has a plurality of radial slits 56 provided therein which adjoin or intersect the circular aperture 54 and each pair of associated slits defines a yieldable resilient holding member 57 therebetween. As the tab 36 is pushed against member 51 the members 57 deflect slightly upwardly and the surface portions 55 engage the outside cylindrical surface of member 51 thereby locking the tab 36 in position preventing its upward pivoting movement. The members 57 of this example also snap beneath head portion 52 of member 51; however, in some applications where such head portion is not employed the members 57 are fully effective in locking the tab 36 flatly in position.

Figure 4:
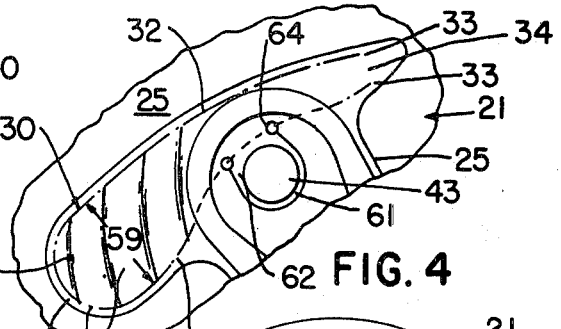
FIG. 4 is a fragmentary plan view of the central portion of the top wall of FIG. 2 drawn to an enlarged scale.

As seen particularly in FIG. 4 of the drawings, the bight 31 of the score line 30 has a maximum distance indicated at 59 thereacross and it will be seen that the ends 33 of the extensions 32 comprising the score line 30 are spaced apart a distance which is no greater than the maximum distance 59. In this example, the approximately U-shaped score line 30 has a roughly teardrop shape which has an enlarged portion defined by the bight 31 and adjoining portions of the pair of extensions 32 and the ends 33 of the extensions are spaced apart a distance which is substantially less than the maximum distance 59.

To facilitate the severing of the panel 35 the score line 30 extends into the wall 21 a greater amount along the enlarged portion of the teardrop shape mentioned above than along the remaining portions thereof to thereby enable such panel to be easily completely severed while remaining attached substantially only at the wall portion 34. Stating this concept in another manner, the score line 30 has the least amount of residual material at the central arcuate portion 60 of its teardrop shape and more residual material beneath the extensions 32. Preferably the residual material beneath extensions 32 increases in thickness at locations remote from the bight and in one application the residual material beneath each extension 32 increases in thickness in approximately direct proportion to the distance from the bight.

As best seen in FIG. 4, the tab 36 has a roughly semicircular slit 61 defining an attachment area 62 therewithin and the attachment area 62 is attached to the wall 21 adjacent one of the pair of extensions 32 employing the integral rivet 43. In particular, an opening 63 (see FIG. 8) is provided in the attachment area 62 and such opening surrounds the lower portion of the rivet 43 whereupon the upper portion of such rivet is riveted thereover to define a head in the conventional manner and thereby attach the tab 36 in position. The tab 36 also has a pair of enlarged circular cutouts 64 adjoining the opposite ends of the semicircular slit 61 and the cutouts 64 define the end points of an imaginary substantially straight bend line for the tab upon lifting the rear portion 38 thereof in the manner previously described.

To assure that the panel 35 is moved within the container 20 in a most efficient manner the panel has a plurality of arcuate strengthening ribs 65 provided therein, see FIG. 5, for example, and such ribs are arranged in approximately parallel relation and extend across the narrow dimension of the elongated teardrop shaped panel. The strengthening ribs 65 are defined as an integral part of the wall 21 as raised projections each having a corresponding depression in the inside surface of the panel and it will be appreciated that the ribs extend roughly transverse the pair of extensions 32 of the score line 20.

Figure 2:
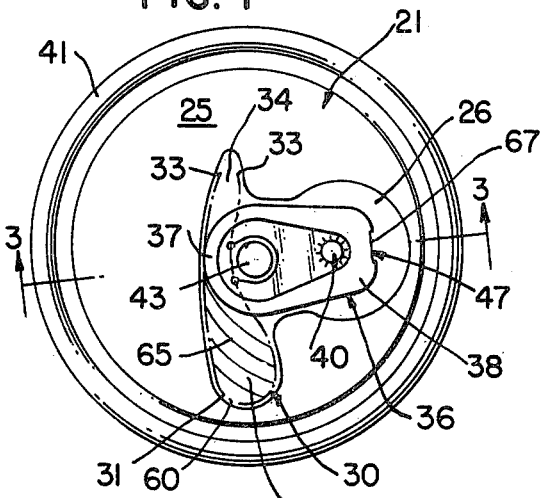
FIG. 2 is a view looking perpendicularly toward the top wall of the container of FIG. 1.

To improve the rigidity of the tab 36 and enable lifting thereof in the manner illustrating in FIGS. 5 and 8 without deflection thereof, the tab 36 has a peripheral stiffening means 66 extending about the major portion of its periphery and has part 67 which was previously indicated at 47 in FIGS. 2 and 3 which is free of such stiffening means and part 67 is in the form of a single thickness portion of tab 36. The stiffening means 66 of this example is in the form of partial bead or an integral flange-like portion.

The tab 36 of this example has its forward portion 37 provided with an arcuate configuration which is semicircular and which is particularly adapted to engage the panel 35 at a location immediately adjacent the extension 32 of the score line 30 which is arranged remote from the rear portion 38 of the tab 36. The terminal circular edge of the semicircular forward portion is arranged substantially in aligned relation immediately above the above-mentioned extension 32. This arrangement enables maximum pressure to be exerted against the panel 35 adjacent the score line and enables initial severing of the previously described comparatively wide slit-like opening 48 in the manner illustrated in FIG. 5 and merely by lifting upwardly on the rear portion 38.

Figure 11:
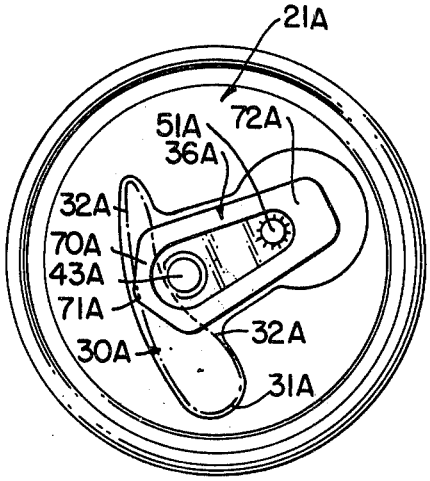
FIG. 11 is a view similar to FIG. 2 illustrating another exemplary embodiment of a top wall which may be used interchangeably with the top wall of FIG. 2 on the container of FIG. 1.

Another exemplary embodiment of an easy-open wall of this invention is illustrated in FIG. 11 of the drawings. The wall illustrated in FIG. 11 is very similar to the top wall 21; therefore, such wall will be designated generally by the reference numeral 21A and parts of wall 21A which are similar to corresponding parts of the wall 21 will be designated by the same reference numerals as in the wall 21, also followed by the letter designation A and not described again. Only those component parts which are different from corresponding parts of the wall 21 will be designated by a new reference numeral, also followed by the letter designation A and described in detail.

The wall 21A differs from the wall 21 primarily in the construction of its tab 36A. In particular, instead of having a tab with a forward portion which has a substantially semicircular configuration, a forward portion 70A is provided which has a substantially arrowhead-shaped or wedge-shaped configuration which has apex 71A and such apex is arranged in substantially vertical alignment above the extension 32A of score line 30A which is arranged remote from a rear portion 72A of the tab 36A. The top wall 21A may be used substantially interchangeably with the wall 21 of the container 20 and it will be appreciated that the panel 35A and tab 36A remain attached to the wall 21A in a similar manner as previously described in connection with the panel and tab of wall 21.

In this example the tab 36A has its attaching means or rivet 43A and fastening means, which includes member 51A, arranged on a central reference axis which is arranged on a diametral line of the basically circular wall 21A; however, it will be appreciated that such reference axis for tab 36A and a similar axis for tab 36 may be spaced from the center of its associated wall, if desired.

Figure 12:
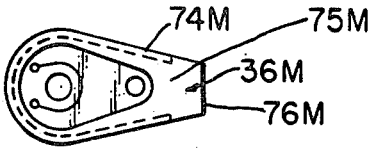
FIG. 12 is a plan view illustrating a modified form of tab.
Figure 13:
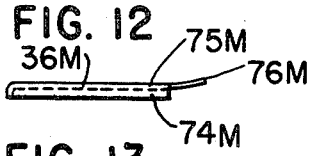
FIG. 13 is a side elevation of the tab of FIG. 12.

Another exemplary embodiment of a tab is shown in FIGS. 12 and 13 of the drawings and designated by the reference numeral 36M. With minor modification of its associated wall, the tab 36M may be used interchangeably with either the tab 36 or the tab 36A. The tab has peripheral stiffening means 74M extending about the major portion of its periphery and has a part 75M of its rear portion which is free of stiffening means. The stiffening means in this example is in a form of a roughly L-shaped flange 74M and the part 75M has an extension 76M extending therefrom which enables easier grasping of its rear portion 38M.

Figure 14:
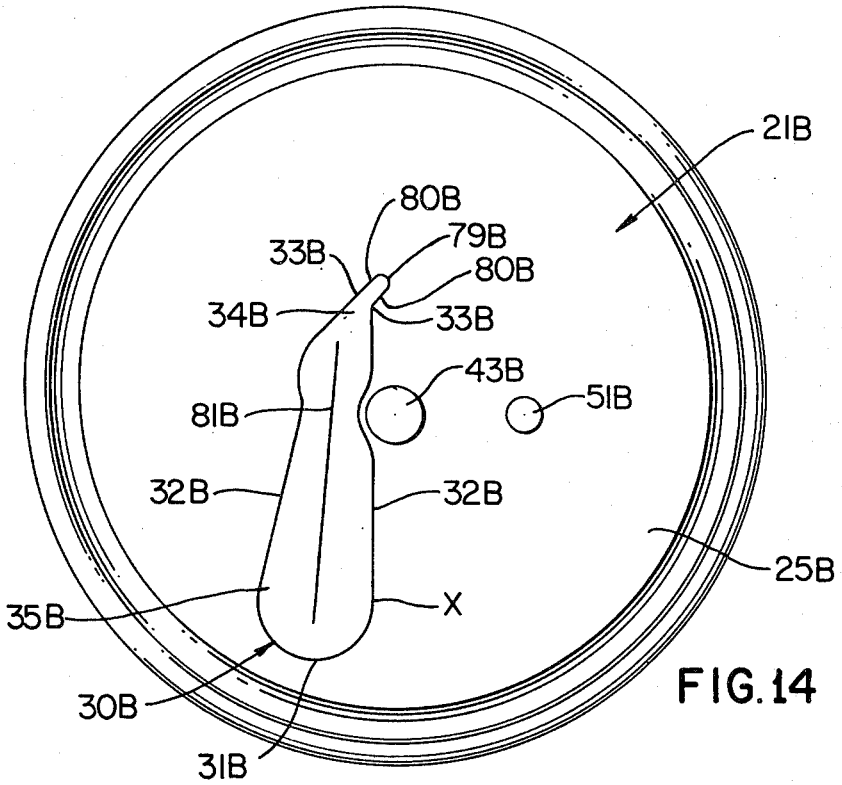
FIG. 14 is a top plan view of another exemplary embodiment of an easy open wall in the form of a top wall for a container with the pull tab unattached and particularly illustrating score means in such wall defining the peripheral outline of a panel with is partially severable to define a dispensing opening for the container.
Figure 15:
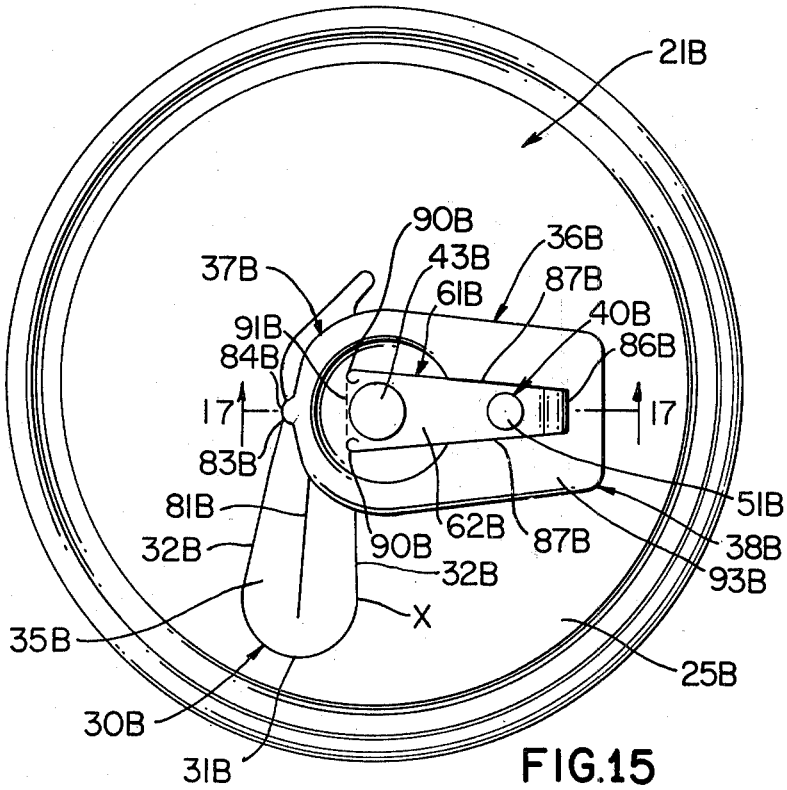
FIG. 15 is a view similar to FIG. 14 illustrating another exemplary embodiment of a pull tab fastened in position on the top wall of FIG. 14 with such pull tab having another exemplary embodiment of means for fastening it against the wall after using the tab to sever the panel.

Another exemplary embodiment of an easy-open wall of this invention is illustrated in FIGS. 14–15. The wall illustrated in FIGS. 14–15 is very similar to the top wall 21; therefore, in a similar manner as was explained in connection with the wall 32A, the wall of FIGS. 14–15 will be designated generally by the reference numeral 21B and parts of the wall 21B which are similar to corresponding parts of the wall 21 will be designated by the same reference numerals as in the wall 21, also followed by the letter designation B and in general not described in detail. Only those component parts which are substantially different from corresponding parts of the wall 21 will be designated by a new reference numeral, also followed by the letter designation B and described in detail.

The main differences between the wall 21B and the wall 21 are that the wall 21B has a main substantially planar portion 25B free of a tab receiving recess therein similar to the recess of the wall 21, the wall 21B has another exemplary embodiment of a tab 36B which has another embodiment of fastening means 40B which will be described in detail subsequently, and the wall 21B has continuous curvilinear score means defined therein as illustrated in FIG. 14 which defines a panel 35B which is partially severable from the wall to define an opening in such wall which is substantially identical to the opening O in the wall 21.

The tab 36B is attached in a nondetachable manner against the wall 21B outwardly of the panel 35B and the tab 36B has a forward portion 37B which overlies a part of the panel 35B and a rear portion 38B which is arranged remote from the panel. The rear portion 38B is also easily grasped and lifted to urge the forward portion 37B downwardly in a pivoted manner against the panel 35B and thereby sever the major portion of such panel and move it within the container with a portion of the wall holding the panel securely thereto and in a manner which will be apparent from the following description.

The continuous curvilinear score means in the wall 21B is comprised of an approximately U-shaped score line 30B which is defined by a bight 31B and a pair of extension legs or extensions 32B and a closing score line 79B which extends between the spaced apart terminal outer ends 33B of the extensions 32B. The closing score line 79B is also approximately U-shaped as will be apparent from FIG. 14; and, in general, each of the roughly parallel legs 80B of score line 79B extends at an angle relative to its adjoining etension 32B; and, in this example, toward the center portion of the wall 21B. This offset or side arrangement of score line 79B assures that once the panel 35B is severed the narrow or top end of the dispensing opening O is arranged a maximum distance from the large diameter end of such opening through which liquid contents of the container utilizing wall 21B may be poured in a substantially non-gurgling manner.

The closing score line 79B has a minimum depth which is roughly one-half or less the depth of the score line 30B at its most shallow portion. The depth of the score line 79B is not sufficient to allow the panel arranged between the parallel legs 80B to be severed yet assures that the portion of such panel bounded by score line 30B is substantially completely severed with wall portion 34B being sharply defined free of slits or tears to assure that the panel 35B is held firmly to the remainder of the wall 21B.

Although the score depth and hence the residual metal will vary depending on the application and metal used, in one application wherein an aluminum alloy having a nominal thickness of 0.0136 inch was used, the curvilinear score means provided scoring such that from point 33B of the extension 32B arranged remote from the center of wall 21B to point X adjacent the bight 31B the amount of residual metal ranged between 0.0045 – 0.0055 inch, the amount of residual material from the point X to the point 33B at the end of the other leg ranged between 0.0060 – 0.0070.

The panel 35B also has a single rectilinear score means or score line 81B which, in essence, bisects the ares of the panel 35B defined by score line portion 30B. The score line 81B serves as a stress-relieving means which assures that the U-shaped score line 30B and closing score line 79B which comprise the continuous curvilinear score line do not create undesirable stresses or stress concentrations in the panel 35B. Thus, once the tab 36B is used to sever the panel 35B the severing action is achieved in an efficient manner while keeping the panel 35B substantially intact with its peripheral outline being sharply defined and free of tears, slits, or the like which might tend to progress into the center of the panel 35B and prevent severing of such panel from the top wall 21B so as to provide a sharply defined opening therein with such opening being substantially identical to the opening "O" in the top wall 21.

The continuous curvilinear score means in the top wall 21B employs tab 36B to sever the panel 35B defined by such score means; however, it will be appreciated that with suitable modification the tab 36, 36A, or any similar tab may be used in association with the closed curvilinear score means illustrated in FIG. 14 to provide an opening O in the associated wall, yet with the panel defining such opening remaining firmly attached to the top wall and within its associated container in accordance with the teachings of this invention.

Figure 16:
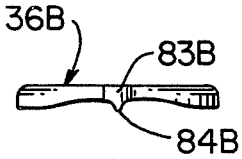
FIG. 16 is a front end view of the pull tab of FIG. 15.

The forward portion 37B of the tab 36B is similar to the forward portion of tab 36 in that both are primarily circular in peripheral outline; however, as illustrated particularly in FIGS. 15 and 16 such forward portion of the tab 36B has the further improvement of an integral projection 83B provided with a sharp V-shaped or knife-like apex or point 84B. The outer end of projection 83B and in particular its point 84B is arranged in substantially vertical alignment above the extension 32B which is arranged remote from the rear portion of the tab 36B. The point 84B of the projection 83B assures that a maximum concentration of force per unit of area is provided against the panel 35B adjacent the extension 32B arranged therebeneath to provide an immediate piercing or severing action in a similar manner as illustrated in FIG. 5 of the drawings in connection with top wall 21.

The tab 36B is attached to the wall 21B by a rivet 43B at a location between the forward portion 37B and the rear portion 38B of such tab and the rivet 43B is defined as an integral part of the wall 21B at a loction which is also closely spaced from and near the center of one of the pair of extensions 32B. The rivet 43B is located so that substantially the entire forward portion 37B of the tab 36B overlies the center portion of the panel 35B. The tab 36B has an integral tubular reinforcing flange 45B which is substantially identical to the flange 45 of the tab 36 and is provided for the same reasons as flange 45 and such reasons need not be repeated at this point. In addition, the tubular reinforcing flange 45B helps keep the tab 36B substantially flush with the top surface of the wall 21B after opening.

The tab 36B has cut or slit means designated generally by the reference numeral 61B defining an attachment area 62B therewithin and the slit means 61B is comprised of a U-shaped slit extending completely through the metal defining the tab 36B and the U-shaped slit has a rectilinear bight 86B adjoined at its opposite ends by a pair of rectilinear extensions 87B. Each extension 87B terminates in an inwardly hooking arcuate end 90B which hook inwardly toward the center of the attachment area 62B and each end 90B is approximately semicircular in configuration. The ends 90B define a bend line for the tab 36B upon lifting the rear portion 38B thereof upwardly about rivet 43B and such a bend line is substantially a rectilinear line which is roughly tangent to the arcuate ends 90B of the extensions 87B and is shown by the dotted line 91B in FIG. 15.

The attachment area 62B defines the central part of the tab 36B and is of extended length and extends across the major portion of the length of the tab 36B. The attachment area or central part 62B of the tab 36B may also be attached parallel to the top wall 21B by a member or tubular rivet 51B which is substantially identical to the rivet 51 provided as an integral part of the wall 21.

Figure 17:
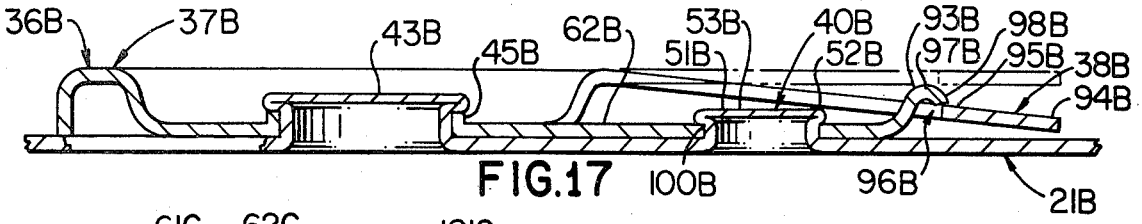
FIG. 17 is an enlarged cross-sectional view taken essentially on the line 17—17 of FIG. 15 after severing the panel and with the fastening means shown in a fastened position by solid lines and with dotted lines showing the unfastened position thereof.

The fastening means 40B for the tab 36B is defined by the central part 62B which has a springlike locking projection 93B and an outer part 94B of the tab 36B which comprises its rear portion 38B. As shown in FIG. 17 the outer part 94B has an engageable top surface 95B and the top surface 95B is adapted to be fastened or locked beneath the locking projection 93B essentially in a snap-fitting manner, as illustrated at 96B in FIG. 17, after severing an opening O in the top wall 21B by lifting the rear portion 38B of the tab 36B in a similar manner as illustrated in FIGS. 5, 6, 7, and 8.

The rivet 51B holds the rear portion of part 62B in a cantilevered manner which helps give the locking projection 93B a springlike character. In addition, the locking projection 93B has an arcuate upwardly convex end portion 97B which has a smooth surface 98B which acts as a cam surface allowing the outer part 94B to be moved into locking position partly by camming action which helps deflect arcuate end portion 97B.

The rivet member 51B is in the form of a cylindrical hollow rivet member defined as an integral part of the top wall 21B and defined in a similar manner as the hollow rivet member 43B. The member 51B has a wall thickness which is substantially the same wall thickness as the top wall 21B and it also has a head portion 52B which has a particular maximum planar area 53B and a downwardly facing annular surface 100B defining the bottom surface of the head portion 52B and which in this example holds the central part 62B against outward movement.

Other exemplary embodiments of pull tabs of this invention are illustrated in FIGS. 18–19, 20–21, 22–23, and 24–25. The pull tabs illustrated in FIGS. 18–19, 20–21, 22–23, and 24–25 are similar to the pull tabs 36; therefore, such pull tabs will be designated by the reference numerals 36C, 36D, 36E, and 36F respectively and representative parts of each pull tab which are similar to corresponding parts of the pull tab 36 will be designated in the drawings by the same reference numerals as in the pull tab 36 (whether or not such components are mentioned in the specification) followed by as associated letter designation either C, D, E, or F and not described in detail. Only those component parts of each pull tab which are substantially different from corresponding parts of the pull tab 36 will be designated by a new reference numeral also followed by an associated letter designation and described in detail.

The pull tabs 36C, 36D, 36E, and 36F may be used on the top wall 21, 21A, 21B in lieu of the pull tabs shown on these top walls. However, for ease of disclosure, each pull tab 36C–F is shown in the drawings installed on the top wall W which is substantially identical to top wall 21B.

Each tab 36C–36F has a roughly semicircular slit defining a corresponding attachment area therewithin and in each instance the slit will be designated by the reference numeral 61 followed by its associated letter designation and the corresponding attachment area will be designated by reference numeral 62 followed by its associated letter designation. Further, in each tab 36C–36F each semicircular slit has opposed inwardly turned arcuate ends and each end will be designated by the reference numeral 90 followed by its associated letter designation. Each tab 36C–36F also has a rectilinear bend line roughly tangent to the inwardly turned or curved ends of its semicircular slit. Each bend line will be represented by dotted lines and designated by the reference numeral 91 also followed by its associated letter designation C, D, E, or F.

Each of the tabs 36C–36F differs from the tabs illustrated previously in this disclosure primarily in the fastening means employed to fasten the tab in position once it has severed an associated teardrop-shaped panel and forced it within an associated container. The forward portion of each tab 36C–36F differs from the forward portion of tab 36 but each is very similar to the forward portion of tab 36B whereby a detailed description of this portion of tabs 36C–36F will not be required.

Figure 18:
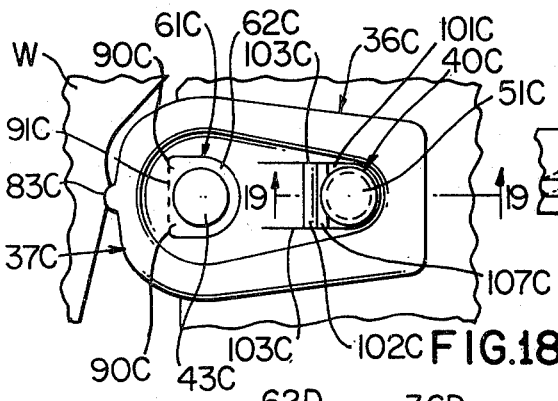
FIG. 18 is a fragmentary plan view illustrating another exemplary embodiment of a pull tab having another exemplary embodiment of tab fastening means with such tab fastening means having severed an associated panel and being shown in a fastened position; and, such pull tab may be used on an associated wall such as the top wall illustrated in FIGS. 1, 11 or 14.
Figure 19:
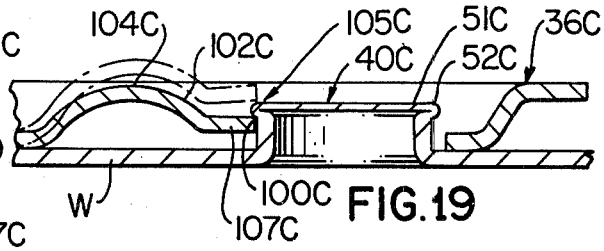
FIG. 19 is a fragmentary cross-sectional view taken essentially on the line 19—19 of FIG. 18 and showing, with dotted lines, the fastening means in an unfastened position.

The fastening means 40C for the tab 36C, see FIGS. 18–19, comprises a rivet 51C which may be considered a locking rivet and is defined as an integral part of its wall W and positioned or arranged beneath the liftable rear portion 38C of the tab. The rear portion 38C of the tab 36C also has an open area 101C therein and a springlike locking projection 102C which is defined as an integral part of such rear portion.

The locking projection 102C is defined by a pair of parallel slits 103C which extend through the wall of the tab 36C and intersect the open area 101C at one end and the locking projection 102C is deflectible and resiliently returns to its original position. The locking projection 102C has an approximately semicylindrical outwardly convex portion 104C which with the locking projection in an unlocked condition rests on the head of the rivet 51C as illustrated at 105C. The locking projection 102C is locked in position by pushing downwardly on the outwardly convex semicylindrical portion 104C to thereby snap the terminal end 107C of the locking projection beneath the head 52C of rivet 51C and against the annular surface 100C. As will be apparent from the drawings locking projection 102C engages a portion of the rivet 51C which is arranged facing toward the center of the top wall W.

Figure 20:
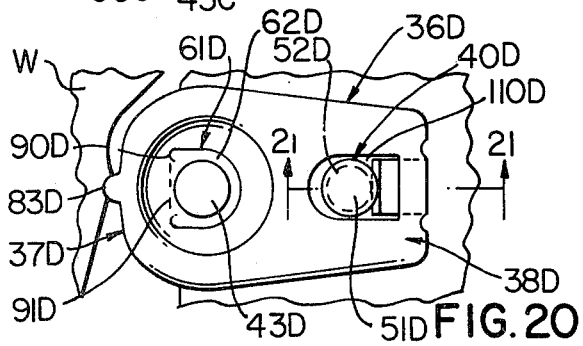
FIG. 20 is a fragmentary plan view similar to FIG. 18 and illustrating another exemplary emobodiment of a pull tab and its fastening means which is similar to and may be used in lies of the pull tab of FIG. 18.
Figure 21:
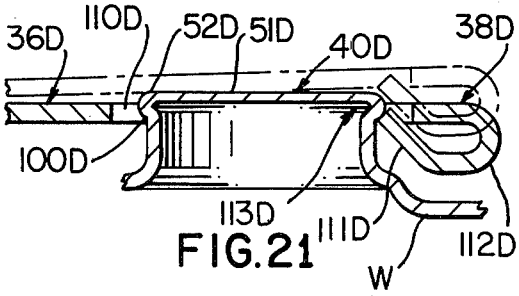
FIG. 21 is a fragmentary cross-sectional view similar to FIG. 19 and taken essentially on the line 21—21 of FIG. 20.

The fastening means 40D for the tab 36D is illustrated in FIGS. 20 and 21 and comprises the locking rivet 51D with its head portion 52D and annular surface 100D. The fastening means 40D also comprises an open area 110D in the rear portion 38D of tab 36D and a springlike projection 111D defined as an integral part of such rear portion. The locking projection 111D is provided as the terminal end of an inwardly hooking and upwardly turned outer end 112D defined as an integral part of the rear portion 38D. The locking projection 111D adjoins the open area 110D and is adapted to be engaged and locked against the annular surface 100D, as shown in 113D in FIG. 21, in a snap-fitting manner.

Figure 22:
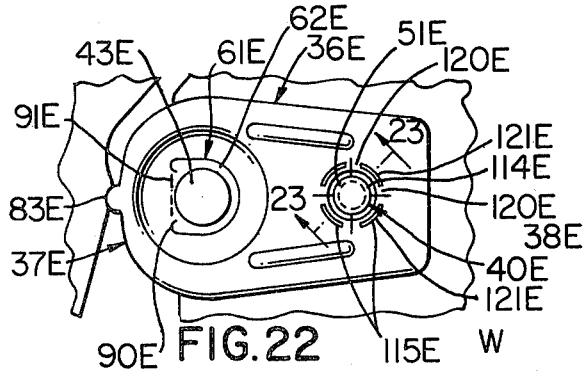
FIG. 22 is a fragmentary plan view similar to FIG. 18 and illustrating another exemplary embodiment of a pull tab and its fastening means which is similar to and may be used in lieu of the pull tab of FIG. 18.
Figure 23:
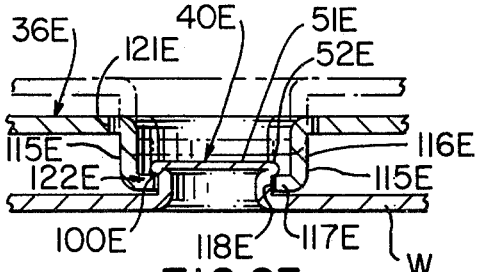
FIG. 23 is a fragmentary cross-sectional view similar to FIG. 19 and taken essentially on the line 23—23 of FIG. 22.

The fastening means 40E for the tab 36E is shown in FIGS. 22 and 23 and comprises the locking rivet 51E defined as an integral part of the wall W and an open area 114E with a plurality of four springlike locking projections spaced 90° apart and each designated by the reference numeral 115E and defined as an integral part of the rear portion 38E of the tab 36E. Each locking projection 115E is roughly L-shaped, as viewed in cross section, and has a vertically extending leg 116E terminating at its lower end in a horizontally extending leg portion 117E. The horizontally extending leg portion 117E has an arcuate inner edge 118E which conforms roughly to the associated portion of the rivet 51E.

Each locking projection 115E is held to the rear portion 38E of the tab 36E by a pair of spaced apart attachment areas or points 120E and has an arcuate slit 121E extending between the spaced attachment points 120E. This construction and arrangement of each locking projection 115E gives a resilient character thereto whereby the horizontal legs 117E thereof may be easily moved radially outwardly around the head 52E of rivet 51E and the inner arcuate edges 118E snap-fitted against the rivet 51E and beneath the annular surface 100E as illustrated at 122E.

Figure 24:
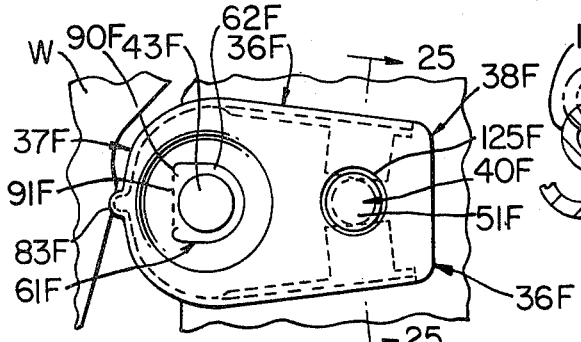
FIG. 24 is a fragmentary plan view similar to FIG. 18 and illustrating another exemplary embodiment of a pull tab and its fastening means which is similar to and may be used in lieu of the pull tab of FIG. 18.
Figure 25:
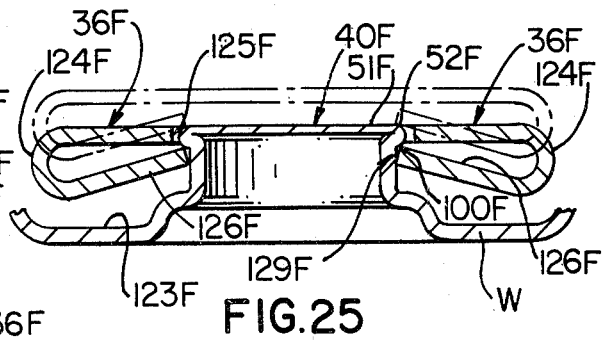
FIG. 25 is a fragmentary cross-sectional view similar to FIG. 19 and taken essentially on the line 25—25 of FIG. 24.

The fastening means 40F for the pull tab 36F is illustrated in FIGS. 24 and 25 and such fastening means comprises the locking rivet 51F provided in the wall W and wall W has an annular recess 123F therein adapted to accommodate diametrically opposed arcuate portions 124F of the tab, as will be apparent from FIG. 25. The fastening means 40F is also comprised of the rear portion 38F of the tab 36F which has an open area 125F therein and a pair of diametrically opposed projections 126F provided at the terminal ends of the arcuate portions 124F. The diametrically opposed projections may be considered locking projections 126F and are adapted to be snap-fitted beneath the head 52F of the rivet 51F against the annular surface 100F as illustrated at 129F.

Each tab 36, and 36A through 36F, is fastened on its associated top wall with its associated fastening means in an unfastened or unlocked condition and once its associated panel is severed the tab is fastened or locked in position as shown by solid lines in FIG. 3 for tab 36, FIG. 11 for tab 36A, and FIGS. 17, 19, 21, 23, and 25 for tabs 36B, 36C, 36D, 36E, and 36F respectively. In its unfastened or unlocked position each tab 36B–F is essentially in the position illustrated by dotted lines in each of FIGS. 17, 19, 21, 23, and 25.

The severing of an associated opening O so that the associated panel is forced within its associated containers, with a portion thereof remaining attached thereto, is achieved essentially in a similar manner as described in detail previously in connection with the panel 35 and the top wall 21 and thus will not be repeated. It is then a simple matter to lock the tab in position utilizing its associated fastening means whereupon for each tab 36B–36F its rear portion is moved until its associated locking projection is fastened or locked in position as shown by solid lines in the drawings.

Figure 26:
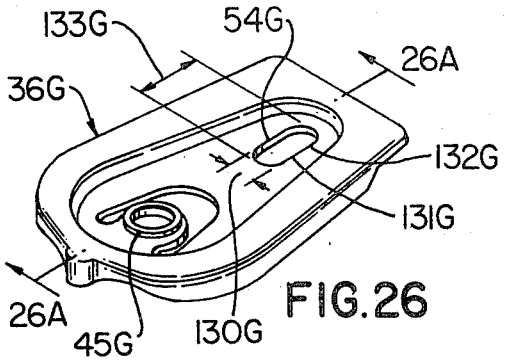
FIG. 26 is a perspective view illustrating another exemplary embodiment of a pull tab having another exemplary embodiment of tab fastening means and such tab may be used on an associated wall such as the top wall illustrated in FIGS. 1, 11 or 14.
Figure 26A:
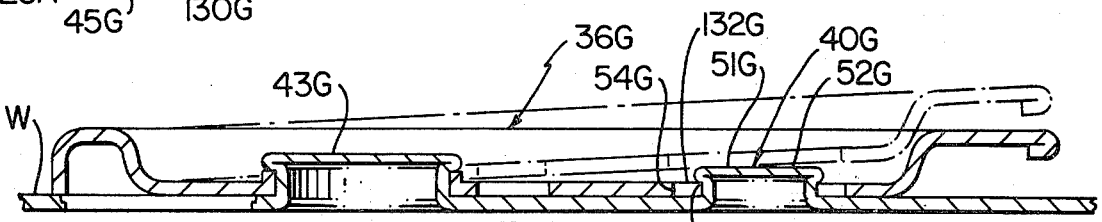
FIG. 26A is a fragmentary cross-sectional view illustrating the tab of FIG. 26 in its fastened position on an associated wall and showing with dotted lines, the tab in an unfastened position.

Another exemplary embodiment of the pull tab of this invention is illustrated in FIGS. 26 and 26A and inasmuch as the pull tab illustrated in FIGS. 26 and 26A is similar to the pull tab 36 such pull tab will be designated by the reference numeral 36G and parts of the pull tab 36G which are similar to corresponding parts of the pull tab 36 will be designated in the drawings by the same reference numerals as the pull tab 36 (whether or not such components are mentioned in the specification) followed by the letter designation G and not described in detail. As previously, only component parts of the pull tab 36G which are substantially different from corresponding parts of the pull tab 36 will be designated by a new reference numeral also followed by the letter designation G and described in detail.

The main difference between the pull tab 36G and the pull tab 36 is in the fastening means 40G and it will be seen that fastening means 40G in the tab 36G comprises a rivet 51G which in a similar manner as previously may be considered a locking rivet and is defined as an integral part of its associated wall which will be designated by the reference letter W, as previously. In addition the fastening means 40G also comprises a cooperating open area in the form of an aperture 54G provided in the tab 36G and the cooperating aperture 54G has an oval or elliptical configuration which has a minor dimension 130G defined by parallel edge portions 131G which are adjoined by top surface portions 132G; and, the dimension 130G is slightly smaller than a corresponding dimension, of a diameter in this case, across the head of the rivet 51C. The aperture 54G has a major dimension indicated at 133G which is substantially greater than the diameter of the head of the rivet 51G.

The tab 36G is fastened or locked in position after severing an associated opening in its wall W by pressing such tab toward the wall W causing the surfaces 131G to snap fit around the head of the rivet 51G and causing the opposed top surface portions 132G to be snap fitted and held urged by the resiliency of the tab material against a downwardly facing annular surface 100g defining the bottom surface of the head portion 52G of rivet 51G.

Figure 27:
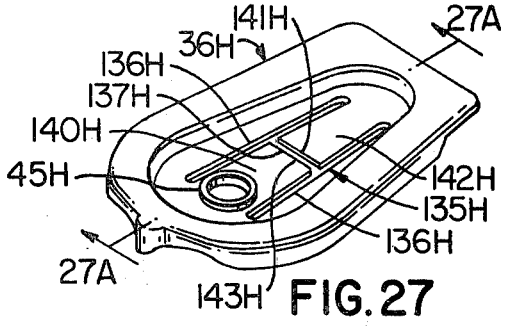
FIG. 27 is a fragmentary plan view illustrating another exemplary embodiment of a pull tab having another exemplary embodiment of tab fastening means and such tab may be used on an associated wall such as the top wall illustrated in FIGS. 1, 11 or 14.
Figure 27A:
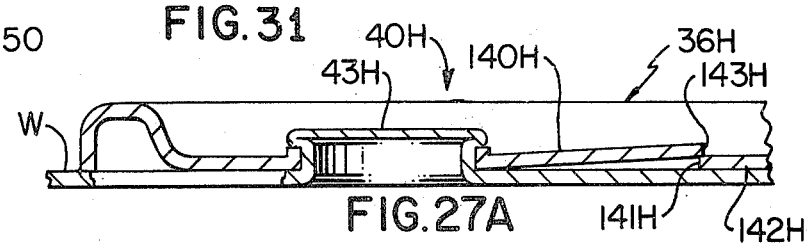
FIG. 27A is a fragmentary cross-sectional view illustrating the tab of FIG. 27 in its fastened position.

Another exemplary embodiment of the pull tab of this invention is illustrated in FIGS. 27 and 27A. The pull tab illustrated in FIGS. 27 and 27A is similar to the pull tab 36 whereby, as previously, such pull tab will be designated by the reference numeral 36H and representative parts of the pull tab 36H which are similar to corresponding parts of the pull tab 36 will be designated in the drawings by the same reference numeral as in the pull tab 36 (whether or not such parts are mentioned in the specification) followed by the letter designation H and not described in detail. As previously, only those component parts of each pull tab which are substantially different from corresponding parts of the pull tab 36 will be designated by a new reference numeral also followed by an associated letter designation and described in detail.

The pull tab 36H as well as the pull tab 36G may be used on the top wall 21, 21A, or 21B in lieu of the pull tabs shown on these walls. However, for ease of disclosure, each pull tab 36G and H is shown in the drawings installed on a top wall which is designated by the letter W.

The pull tab 36H is quite different from the other pull tabs illustrated and described previously in this disclosure in that it does not require the use of a locking rivet and indeed only the rivet 43H which holds the tab 36H on its wall W is required; yet, the construction of the pull tab 36H is such that it has integral fastening or locking means designated by the reference numeral 40H which are particularly adapted to fasten or lock the tab flatly against its associated wall W once the tab 36H has been used to sever an associated panel in a similar manner as described previously.

The pull tab 36H is held on its associated wall W by the rivet 43H and it will be seen that the tab has a substantially H-shaped cutout therein which is designated generally by the reference numeral 135H. The cutout 135H has a pair of parallel leg portions 136H and a transverse leg portion 137H. As will be readily apparent from FIG. 27 of the drawings the tab 36H is held against its wall W by rivet 43H, which is integral with the wall W, and which is attached to a metal portion 140H defined by transverse leg portion 137H of cutout 135H and those parts of the parallel leg portions 136H of the cutout 135H arranged closest to the forward end of the pull tab 36H.

When the tab 36H is used to sever an associated panel the pull tab, except for portion 140H, moves forward in a similar manner as described in connection with FIGS. 5, 6, 7, 8, 9, and 10 for the tab 36; and, once the panel has been severed the tab 36H is returned flatly against its associated wall W. However, the construction and arrangement of component portions of the tab 36H is such that a forward tip 141H of a metal portion 142H defined by leg portion 137H and those parts of the parallel leg portions 136H of cutout 135H arranged remote from the forward end of the tab 36H is moved forwardly toward the rivet 43H. As the tab is returned flatly against wall W there is a slight overlap of tip 141H over a rear portion of portion 140H and continued movement of tab 36H toward wall W causes portion 141H to snap lock beneath portion 143H causing the tab to be fastened or locked against the wall W. With this construction it will be seen that no additional locking rivet is needed and the single rivet 43H is used to hold the tab 36H on its associated wall W yet the unique fastening is provided in a similar manner as described in connection with the other tabs disclosed previously.

Each of the tabs 36, 36A, 36B, 36C, 36D, 36E, 36F, 36G and 36H may be provided with flexible reinforcing means to allow each tab to be flexed about its bend line in a nonbreaking manner. In general, a particular material utilized to define a particular tab is such that flexible reinforcing means is not required. However, such reinforcing means is provided to assure against breakage of the tab after severing of the associated panel, urging of such panel within its associated container, and fastening the tab against its wall with associated fastening means.

Various embodiments of flexible reinforcing means may be provided and each of such reinforcing means is applied against the attachment area so as to reinforce the bend line of the associated tab against which such flexible reinforcing means is applied. Further, in this disclosure, each reinforcing means is shown being applied to the tab 36B; however, it is to be understood that each disclosed embodiment of flexible reinforcing means may be applied to each of the tabs 36 and 36A–36H disclosed herein.

Figure 28:
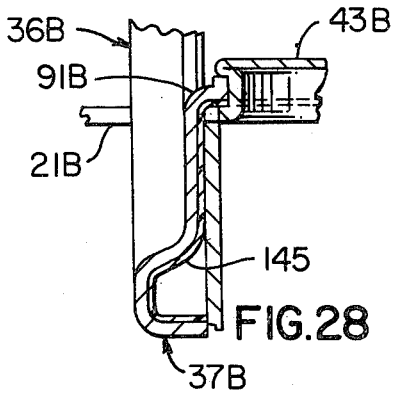
FIG. 28 is a fragmentary cross-sectional view of a typical modified tab which may be any of the tabs described above and provided with flexible reinforcing means fixed against is bottom surface and the manner in which such flexible reinforcing means allows the tab to be bent about an associated bend line in a non-breaking manner during the severing of an associated panel.

One embodiment of reinforcing means is illustrated in FIG. 28 and is in the form of a layer 145 of platic material suitable applied against the bottom surface of the tab. The layer of plastic material 145 covers substantially the entire inside surface of the tab 36B and reinforces the bend line 91B so that even if the metallic material used to define the tab 36B were to shear or break the layer of plastic material 145 would still hold the forward portion 37B of the tab attached to its rear portion. The plastic material which defines layer 145 is such that there is a tenacious bond between it and the bottom surface of the tab 36B and there is no need for additional adhesive means, or the like.

Figure 29:
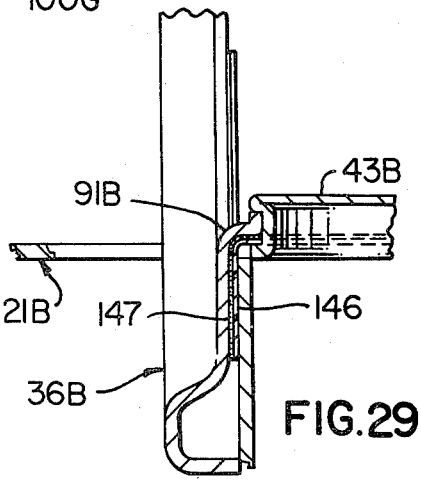
FIG. 29 is a fragmentary cross-sectional view illustrating another embodiment of flexible reinforcing means which may be adhesively bonded against the bottom surface of the tab of FIG. 15 to define another modification of such tab.

Another embodiment of flexible reinforcing means is illustrated in FIG. 29 and is in the form of a separate rectangular strip 146 of a plastic material and the strip 146 is suitably bonded to the inside surface of the tab 36B by adhesive means 147. The plastic strip 146 provided reinforcement in the area of the bend line 91B in a similar manner as described previously.

Figure 31:
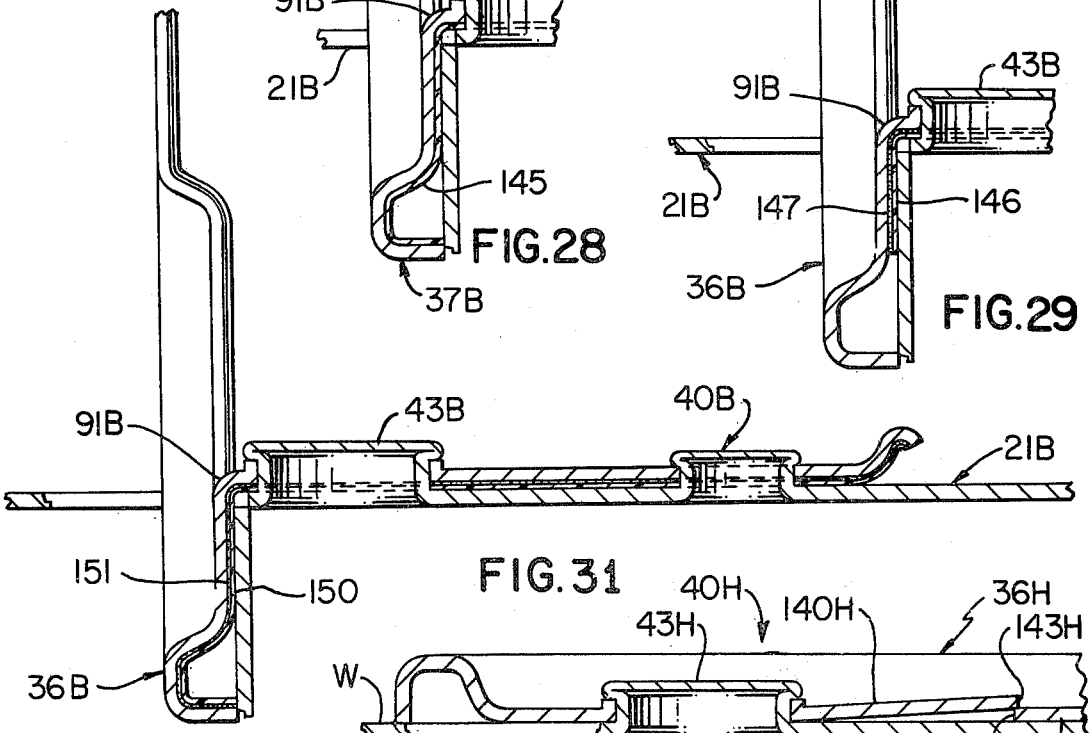
FIG. 31 is a fragmentary cross-sectional view particularly illustrating the manner in which the flexible reinforcing means allows the tab of FIG. 30 to be bent about its associated bend line in a non-breaking manner.
Figure 30:
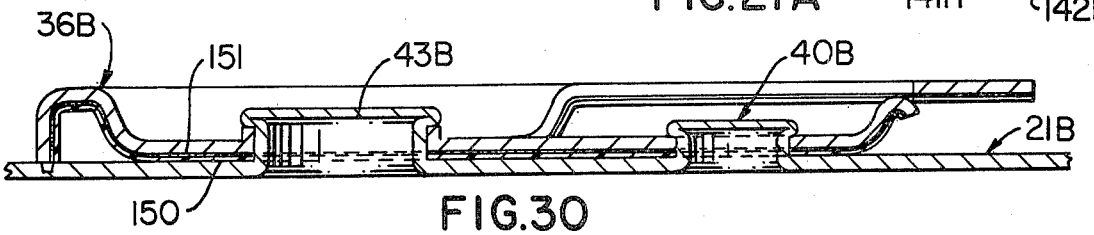
FIG. 30 is a fragmentary cross-sectional view illustrating still another exemplary modification of the tab having another embodiment of flexible reinforcing means fixed against its bottom surface.

The flexible reinforcing means illustrated in FIGS. 30 and 31 is preferably in the form of a layer of plastic material 150 which is suitably adhesively bonded by adhesive means 151 to the inside surface of the tab 36B and the plastic material is preferably bonded so as to provide a tenacious bond between the metal defining the tab 36B and the layer 150 prior to forming the tab. The metallic material used to define the fastening tab and the plastic material 150 are preferably provided in sheet or web form from supply rolls thereof. The sheet or web of metal is cleaned and pretreated in accordance with techniques known in the art whereupon the sheet is passed through a coating station where a suitable adhesive 151 is applied thereagainst. In applications where the adhesive 151 contains solvents it is passed through an oven under controlled conditions to remove such solvents whereupon the plastic film 150 may be adhered thereagainst by means of heat and pressure in accordance with any technique known in the art.

Any suitable adhesive may be used as the adhesive 151 and such adhesive may comprise vinyls, polyesters, urethanes, acrylics and modifications or combinations of these with other resins.

Any suitable plastic film may be used to define the film 150 including a film comprised of polyolefins, vinyls, nylons, ethylene and propylene copolymers and alloys of various resins. In addition, each of the films may be suitably treated or coated to make it more suitable for lamination. One example of a plastic flexible reinforcing means is sold under the trademark of MYLAR by the E. I. DuPont de Nemours Co., Inc. of Wilmington, De.

In this disclosure of the invention flexible reinforcing means has been described as being suitably applied to the bottom surface of a tab, i.e., bottom being defined as that surface closely adjacent an associated wall once the tab is fastened in position on its end closure; however, it is to be understood that flexible reinforcing means for such tab could be provided on the top surface or on both surfaces, if desired.

Each flexible reinforcing means is described above as being a plastic material, however, any suitable elastomeric material including natural and synthetic rubber compounds may be used for this purpose. Further, regardless of the materials used to define the flexible reinforcing means and/or adhesive therefor it is to be understood that such materials are such that they will not be attacked or damaged by the product contained within the associated container; and, similarly, these materials will not adversely affect such product.

Still another exemplary embodiment of an easy-open wall of this invention is illustrated in FIGS. 32–40 of the drawings. The wall illustrated in FIGS. 32–40 is very similar to the top wall 21; therefore, in a similar manner as explained previously in connection with the walls 21A and 21B, the wall of FIGS. 32–40 will be designated generally by the reference numeral 21J, so as to avoid confusion with other embodiments described previously, and parts of the wall 21J which are similar to corresponding parts of the wall 21 will be designated by the same reference numerals as in the wall 21, also followed by the letter designation J and in general not described in detail. Those component parts which are substantially different from corresponding parts of the wall 21 will be designated by a new reference numeral also followed by the letter designation J and described in detail.

The main difference between the wall 21J and the wall 21 is that the wall 21J employs another exemplary embodiment of a tab which is designated 36J; and, tab 36J is free of additional fastening means, for the purpose of holding such tab flatly against its wall, and is rotatable about attaching means in the form of an integral rivet provided in the wall 21J.

The wall 21J has continuous curvilinear score means defined therein in a similar manner as explained in connection with FIG. 14. for the wall 21B and such curvilinear score means defines a panel 35J which is partially severable from the wall to define an opening O in such wall which is substantially identical to the opening O in the wall 21B. The tab 36J is attached in a nondetachable manner against the wall 21J by attaching means comprising an integral rivet 43J and outwardly of the panel 35J and tab 36J has a forward portion 37J and a rear portion 38J.

In a similar manner as in the easy-open wall 21B the continuous curvilinear score means in the wall 21J comprises of an approximately U-shaped score line 30J which is defined by a bight 31J and a pair of extension legs or extensions 32J which terminate in spaced ends 33J, and a closing score line 79J which extends between the spaced apart terminal outer ends 33J of the extensions 32J. The closing score line 79J is approximately U-shaped and has a pair of roughly parallel legs 80J which extend at an angle relative to associated extensions 32J to provide an offset or side arrangement of the score line 79J for a similar purpose as explained in connection with similar portions of the easy-open wall 21B. The closing score line 79J also has a minimum depth which is not sufficient to allow the panel arranged between the parallel legs 80J to be severed for similar reasons as explained before in connection with the easy-open wall 21B.

The integral rivet 34J is used to attach the tab adjacent one of the extensions 32J thereof so that the forward portion 37J of the tab overlies the central portion of the panel 35J prior to severing of such panel. The rear portion 38J of tab 36J is easily grasped and lifted to urge the forward portion against the panel to thereby sever the panel 35J and move it within the associated container on which the top wall 21J is fastened with the wall portion 34J holding the panel 35J securely to the wall 21J.

Figure 40:
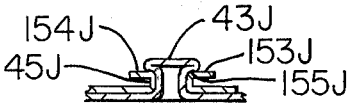
FIG. 40 is a cross-sectional view taken essentially on the line 40—40 of FIG. 32.

The tab 36J is rotatably attached to wall 21J by attaching means comprised of the rivet 43J and flange means in the attachment area 61J and being in the form of an integral tubular reinforcing flange 45J and an annular outturned flange portion 153J, with both components being defined as an integral part of the tab 36J, see FIG. 40. The rivet 43J and flange 153J enable the tab to be returned with its rear portion 38J near the main portion of the wall 21J. The rotation of the rotatable tab 36J is achieved in a manner to be described in detail subsequently but basically is achieved to provide rotation generally of the order of 90° and such rotation is such that the tab is moved from the position illustrated in FIG. 35 to the position illustrated in FIG. 38.

The flange portion 153J provides a substantial annular top bearing surface 154J which engages a bottom annular surface portion 155J of the rivet 43J and allows sliding rotation of the tab 36J.

Figure 35:
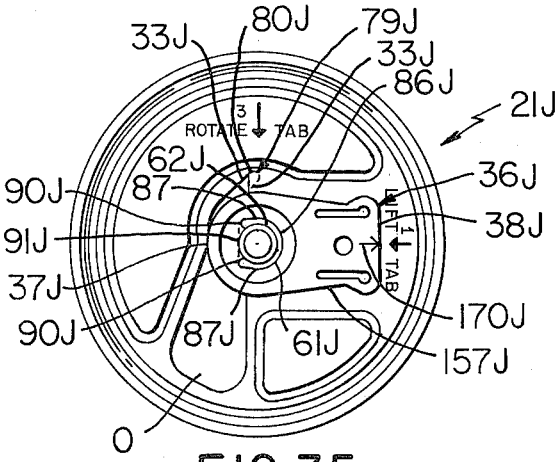
FIG. 35 is a view similar to FIG. 32 showing the rear position of the push tab returned near the wall.
Figure 36:
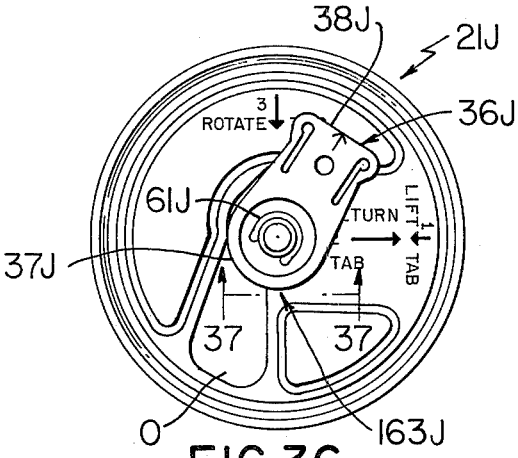
FIG. 36 is a view similar to FIG. 35 illustrating the push tab rotated through an angular increment.

The tab 36J has cut or slit means designated generally by the reference numeral 61J and defining an attachment area therewithin. The cut or slit means 61J is comprised of a U-shaped slit extending completely through the meal defining tab 36J and the U-shaped slit has an arcuate bight 86J adjoined at its opposite ends by a pair of extensions 87J and each extension 87J terminates in an inwardly hooking approximately semicircular arcuate end 90J which hooks inwardly toward the center of the attachment area 62J for the tab 36J. Each end 90J is approximately semicircular in configuration. The arcuate ends 90J define a bend line for the tab 36J upon lifting the rear portion 38J thereof upwardly about the rivet 43J and such a bend line is a substantially rectilinear line 91J which is roughly tangent to the arcuate ends 90J of the extensions 87J and as shown in FIG. 35.

The tab 36J has a peripheral flange-like portion 157J terminating in a bottom edge 160J (FIG. 37) and such bottom edge has a substantially wedge-shaped configuration 161J at the front end of the forward portion 37J when viewed normal to the forward portion of the tab in a direction substantially parallel to the longitudinal axis thereof. One side portion 162J of the wedge-shaped configuration 161J is in the form of a surface which operates as a cam surface or cam means which is particularly adapted to engage the wall 21J adjacent the near extension as shown at 163J in FIGS. 36 and 37 to thereby pivot the tab 36J about its attaching means including rivet 43J to thereby urge the rear portion 38J toward the wall 21J and the entire tab substantially parallel to wall 21J.

Figure 37:
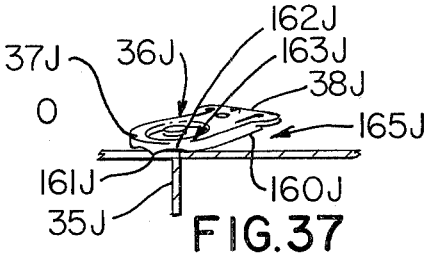
FIG. 37 is a view taken essentially on line 37—37 of FIG. 36.

The cam action of the cam surface 162J is provided under conditions where the rear portion 38J of the tab is not returned substantially flatly against the top wall 21J whereby the rear portion of the tab is essentially as shown at 165J in FIG. 37. With the tab 36J thus arranged rotation of such tab from the position of FIG. 35 to that of FIG. 38 causes the cam surface 162J to provide its cam action whereby the apex of the wedge-shaped configuration 161J of the tab 36J engages the wall 21J and provides pivoting of the tab about the rivet 43J and urging of the rear portion 38J and the entire tab 36J so that it is substantially parallel to the wall 21J.

Having described the components of the easy-open wall 21J the detailed description will now proceed with a description of the manner in which the tab 36J of such wall is used to sever the severable panel 35J and define an opening O therein in a similar manner as presented in other previously disclosed embodiments of this invention. In particular, it will be seen that the rear portion is easily grasped by inserting a fingernail or other object therebeneath and then lifted by following the instruction and arrow "1 lift tab" as shown at 166J in FIG. 32.

Figure 34:
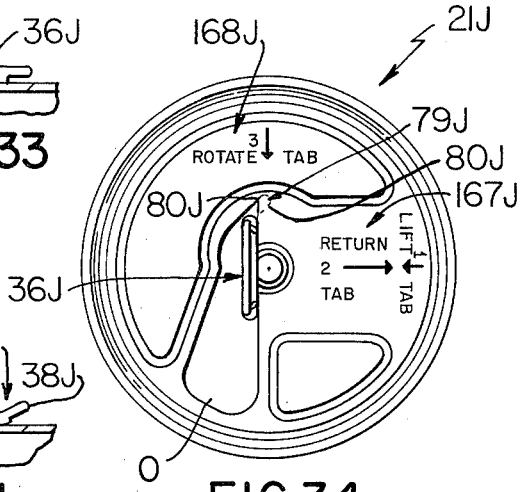
FIG. 34 is a view similar to FIG. 32 and illustrating the push tab thereof in a substantially vertical position resulting in the severing of the asociated panel and the formation of a dispensing opening in such easy-open wall.

The tab is lifted so that it extends substantially vertically thereby completely severing the panel 35J and defining the opening O in the top wall 21J whereby the tab is in the position shown in FIG. 34 and in this position the further instruction arrow and number 2 are exposed stating "2 return tab" as indicated at 167J in FIG. 34. For the purpose of this description it will be assumed that the return is not such that the tab 36J is returned flatly against the top wall. The next instruction is indicated at 168J by the number 3 and arrow and states "3 rotate tab."

Figure 38:
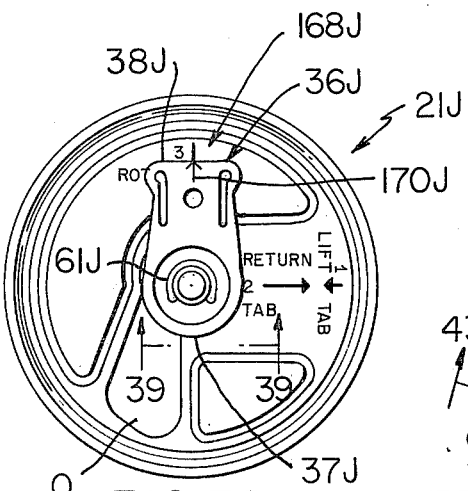
FIG. 38 is a view similar to FIG. 36 showing the tab rotated 90° from its original position.

It will also be noted that there is an arrow 170J on the tab and upon aligning arrow 170J with the arrow at 168J the tab is in the position shown in FIG. 38. During rotation from the position of FIG. 35 to that of FIG. 38 the cam surface 162J comes into operation to urge the tab 36J substantially flatly against the top wall as described earlier.

In the event that the tab 36J is returned substantially flatly against the top wall by a user after severing the opening O, the rear portion 38J of the tab would not be in position to obstruct drinking directly from the container on which the easy-wall 21J is utilized whereby it would not be necessary to rotate the tab 36J. Nevertheless, if under these circumstances the tab were to be rotated to the position illustrated in FIG. 38 it has been found that there is a tendency for the rear portion to still move substantially against the top wall 21J in a manner which is not feasible without tab rotation and this is believed due to the manner in which the metal is distorted adjacent the rivet 43J during the process of severing the panel 35J to define the opening O.

Figure 32:
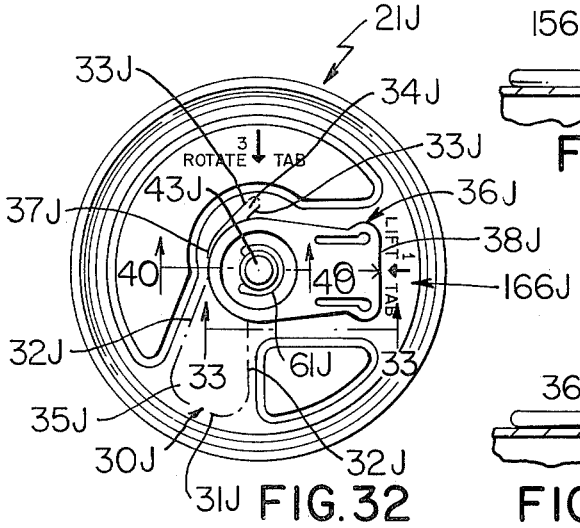
FIG. 32 is a top plan view of another exemplary embodiment of an easy-open wall in the form of a top wall for a container particularly illustrating a push tab which is rotatable about its attaching means after severing a severable panel provided in such easy-open wall.
Figure 33:
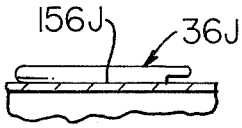
FIG. 33 is a view taken essentially on the line 33—33 of FIG. 32.
Figure 41:
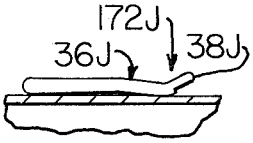
FIG. 41 is a view similar to FIG. 33 showing a modification of the tab of FIG. 32.

To facilitate easy grasping of the rear portion 38J of the tab 36J such tab may be modified as illustrated at 172J in FIG. 41 to provide an upturned terminal end at the rear portion 38J whereby such modified tab may be used interchangeably with the tab shown in FIG. 32.

Figure 42:
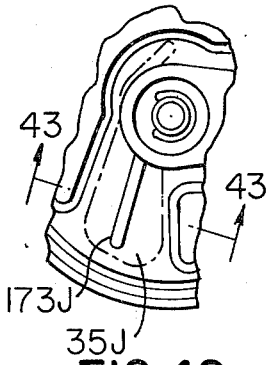
FIG. 42 is a fragmentary view showing a modification of the easy-open top wall of FIG. 32 which utilizes a longitudinal strengthening rib extending along the severable panel to assure efficient severing of the opening defined by the panel.
Figure 39:
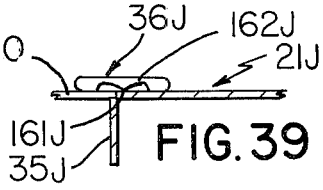
FIG. 39 is a view taken essentially on the line 39—39 of FIG. 38.
Figure 43:
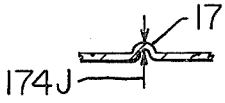
FIG. 43 is a cross-sectional view taken essentially on the line 43—43 of FIG. 42.

It will also be appreciated that in order to assure more efficient severing thereof the panel 35J may have a longitudinal strengthening rib or ridge 173J extending along the longitudinal axis thereof with the rib being in the form of an undulation in the wall 21J. The undulation 173J preferably has a wall thickness as indicated at 174J in FIG. 43 which is substantially equal to the thickness of the remainder of the wall. It will be appreciated that the top wall 21J may be provided with a severable panel in the form of a plain panel as shown in FIG. 32 or such severably panel may have a reinforcing rib means 173J or the like, as shown in FIGS. 42 and 43 to assure more efficient severing thereof and in an accelerated manner.

It will also be appreciated that each tab 36, 36A through 36H and 36J disclosed herein may be made of laminated high temper and low temper metal alloys for the purpose of providing strength and ductility respectively.

Each of the tabs 36, 36A–36H and 36J may be made of materials containing aluminum or may be made of ferrous materials. It has been found that steel tabs when used on associated walls having locking or fastening rivets made of aluminum provide excellent locking action.

In this disclosure of the invention integral tubular reinforcing flanges 45, 45B and 45J have been shown on tabs 36, 36B, and 36J respectively; however, it is to be understood that such tubular reinforcing flanges may be provided on each of the tabs disclosed herein and indeed it is preferred that similar flanges be provided for similar reasons as set forth previously.

While present exemplary embodiments of this invention, and methods of practicing the same, have been illustrated and described, it will be recognized that this invention may be otherwise variously embodied and practiced within the scope of the following claims.

What is claimed is:

1. An easy-open end wall for a beverage container, said end wall having a periphery, a rupturable score line in said end wall defining most of the periphery of a non-removable tear panel while leaving an integral hinge between the panel and the remainder of the end wall, a non-detachable tab, means for attaching said tab to said end wall in a region adjacent to but outside of said tear panel and providing for pivotal movement of said tab about an axis transverse to the length of said tab, said score line including two spaced portions extending from said region away from said tab, said score line extending from said two spaced portions into a generally arcuate section, said tab having a forward, rupturing portion that overlies a minor part of said tear panel adjacent said region and with the greater part of said tear panel being uncovered by and extending away from said tab toward said generally arcuate section, said tab having a rear portion being adapted to be easily grasped and lifted up to urge said forward portion against said panel as the tab is pivoted about said axis to rupture said score line and depress said panel away from said end wall and about its hinge to open position, the initial listing movement of said tab rear portion effecting an initial rupturing of said score line adjacent said tab forward portion and further lifting of said tab rear portion causing propagation of the initial rupturing of the score line away from said tab forward portion and into said generally arcuate section of said score line.

2. The structure defined in claim 1 wherein said two spaced portions of said score line diverge as they extend outwardly from said region.

3. The structure defined in claim 1 wherein said means for attaching said tab to said end wall comprises a rivet formed in said end wall adjacent said tear panel.

4. The structure defined in claim 1 wherein propagation of the initial rupturing of the score line is effected through one of said two spaced portions then through said generally arcuate section, and then through the other of said two spaced portions of said score line.

5. The structure defined in claim 4 wherein said tab forward rupturing portion has a generally semicircular periphery that is urged against the tear panel as said tab rear portion is lifted up to effect said initial rupturing and said propagation.

6. The structure defined in claim 5 wherein said tab forward rupturing portion overlies at least one of said two spaced portions of said score line.

7. The structure defined in claim 4 wherein said tab is arranged in a position substantially flat with respect to said end wall prior to opening and is adapted to be returned to that position after depressing said tear panel and without causing return movement of said tear panel toward said end wall.

8. The structure defined in claim 1 wherein said region is disposed at about the center of said end wall.

9. The structure defined in claim 1 wherein said tab comprises: a first member of a first material extending substantially the length of the tab and providing rigidity against transverse bending; a second member of a second material; said means for attaching said tab and providing for said pivotal movement thereof comprising means for connecting said tab to attachment means on said end wall and including a portion bendable for permitting said pivotal movement; said bendable portion comprising parts of said first and second members; said first material having greater strength than said second material; and said second material being more capable of being bent back and forth without breaking than said first material.

10. An easy-open container end with nondetachable means for making an opening therethrough suitable for pouring, comprising:

an end wall, a rupturable score line in the end wall defining most of the periphery of a nonremovable tear panel, while leaving an integral hinge between the panel and the remainder of the end wall, said score line extending away from one end of the hinge, around a bight where it is distant from the hinge, and back to the other end of the hinge, a tab extending generally parallel and close to an underlying area of the end wall, a rear part of the tab being engageable for upward lifting, and a forward part of the tab overlying a minor portion of the tear panel, and attaching means on the end wall in a region thereof adjacent the score line and outside the tear panel, said attaching means being nondetachably secured to connecting means on the tab, said attaching and connecting means permitting pivotal movement of the tab when the rear part of the tab is lifted up from the container and, while the forward end of the tab correspondingly swings down, the score line being subject to initial rupture when the rear end of the tab is partially lifted to cause the forward end of the tab to press down on the panel, continued pivotal movement of the tab, about an axis generally parallel to the underlying area of the end wall and close to the said attaching means, being effective to propagate the rupture of the score line, and to swing the panel down about its hinge to open position, and the forward part of the tab being adapted to press initially against the tear panel at a place farther forward of said axis of pivotal movement than both ends of the panel hinge.

11. The structure defined in claim 10 wherein the greater part of said tear panel is outside of the area covered by the tab in its initial position and extends away from said area toward said bight, wherein said initial rupture of the score line occurs in a region adjacent one end of said hinge and further wherein the initial rupture is propagated throughout the entire length of the score line between the ends of said hinge.

12. The structure defined in claim 11 wherein said attaching means comprises a rivet integrally formed in about the center of said end wall.

13. The structure defined in claim 11 wherein said tab forward part has a generally arcuate periphery that is urged against the tear panel as said tab rear part is lifted up to effect said initial rupture and the propagation thereof.

14. The structure defined in claim 11 wherein said tab is adapted to be returned toward a position generally parallel and close to an underlying area of the end wall, after the score line is ruptured, and the tear panel is swung downwardly, without causing return movement of said tear panel toward said end wall.

15. The structure defined in claim 10 wherein the length of said hinge is substantially less than the maximum dimension of the tear panel.

16. The structure defined in claim 10 wherein said tab comprises: an elongated portion adapted to serve as a rigid lever and including said forward and rear parts of said tab; a first member of a first material extending substantially the length of said elongated portion and providing rigidity against transverse bending when the tab is used as a lever; a second member of a second material; means for connecting said tab to said attaching means and including a portion bendable for permitting said pivotal movement of said tab; said bendable portion comprising parts of said first and second members; said first material having greater strength than said second material; and said second material being more capable of being bent back and forth without breaking than said first material.

* * * * *

UNITED STATES PATENT OFFICE

CERTIFICATE OF CORRECTION

Patent No. 3,967,753 Dated July 6, 1976

Inventor(s) CUDZIK, Daniel F.

It is certified that error appears in the above-identified patent and that said Letters Patent are hereby corrected as shown below:

Column 1, line 39, after "with" insert --the--.
Column 2, line 39, change "with" to --which--.
Column 2, line 68, change "lies" to --lieu--.
Column 3, line 37, change "is" to --its--.
Column 3, line 66, correct the spelling of "associated"
Column 4, line 2, change "position" to --portion--.
Column 5, line 15, change "be" to --by--.
Column 5, line 15, change "discharging" to --discarding--.
Column 7, line 55, change "illustrating" to --illustrated--.
Column 7, line 62,before "partial" insert --a--.
Column 8, line 29, after "has" insert --an--.
Column 8, line 63, change "32A" to --21A--.
Column 9, line 39 change "etension" to --extension--.
Column 10, line 3, change "ares" to --area--.
Column 11, line 59, change "as" to --an--.
Column 12, line 2, change "the" to --a--.
Column 12, line 67, change "in" (first occurrence) to --at--.
Column 14, line 34, change "100g" to --100G--.
Column 15, line 61, change "platic" to --plastic--.
Column 15, line 62, change "suitable" to --suitably--.
Column 16, lines 9-10, change "provided" to --provides--.
Column 19, line 42, change "severably" to-severable--.
Column 20, line 24, change "listing" to --lifting--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*